United States Patent [19]

Lerman

[11] 4,148,555

[45] Apr. 10, 1979

[54] TARGET WITH SCORE INDICATOR

[75] Inventor: Victor S. Lerman, Malden, Mass.

[73] Assignee: Martin Yale Industries, Inc., Chicago, Ill.

[21] Appl. No.: 818,408

[22] Filed: Jul. 25, 1977

[51] Int. Cl.[2] ..... A63B 69/40

[52] U.S. Cl. ..... 273/26 A; 273/102.1 C; 273/127 C; 273/DIG. 26

[58] Field of Search ..... 273/26 A, 127 R, 127 B, 273/102.1 R, , 102.1 B, 102.1 C, 102.1 F, 127 B, 14, 105 R, 102 R, 102.2 R, 103, 181 R, 181 J, 181 K, 182 R, 183 R, DIG. 26; 272/DIG. 5

[56] References Cited

U.S. PATENT DOCUMENTS

| | | | |
|---|---|---|---|
| 668,157 | 2/1901 | Browning | 235/122 |
| 975,237 | 11/1910 | Heusser | 235/114 |
| 1,170,467 | 2/1916 | Taylor | 272/76 |
| 1,678,762 | 7/1928 | Beskow | 235/122 |
| 2,247,501 | 9/1941 | Jenks et al. | 273/181 R |
| 3,170,692 | 2/1965 | Keosiff | 273/102.1 C |
| 3,206,196 | 9/1965 | Jackson | 273/26 A |
| 3,428,324 | 2/1969 | Weisbecker | 235/122 |
| 3,638,940 | 2/1972 | Mehaulic | 272/DIG. 5 |
| 3,706,451 | 12/1972 | Dixon | 273/26 A |
| 3,756,599 | 9/1973 | Imatt | 273/102.1 C |

*Primary Examiner*—Richard T. Stouffer
*Assistant Examiner*—T. Brown
*Attorney, Agent, or Firm*—Vogel, Dithmar, Stotland, Stratman & Levy

[57] ABSTRACT

A target type scoring device which includes a target formed of a resilient material such as a net supported by elastic members and a frame, there being a trigger positioned behind the target and reciprocally movable toward and away therefrom. A cam and cam follower arrangement interconnect the trigger and an indicia or score indicating display causing the display to rotate upon actuation of the trigger by an object thrown against the target in a scoring area.

9 Claims, 4 Drawing Figures

FIG. 3
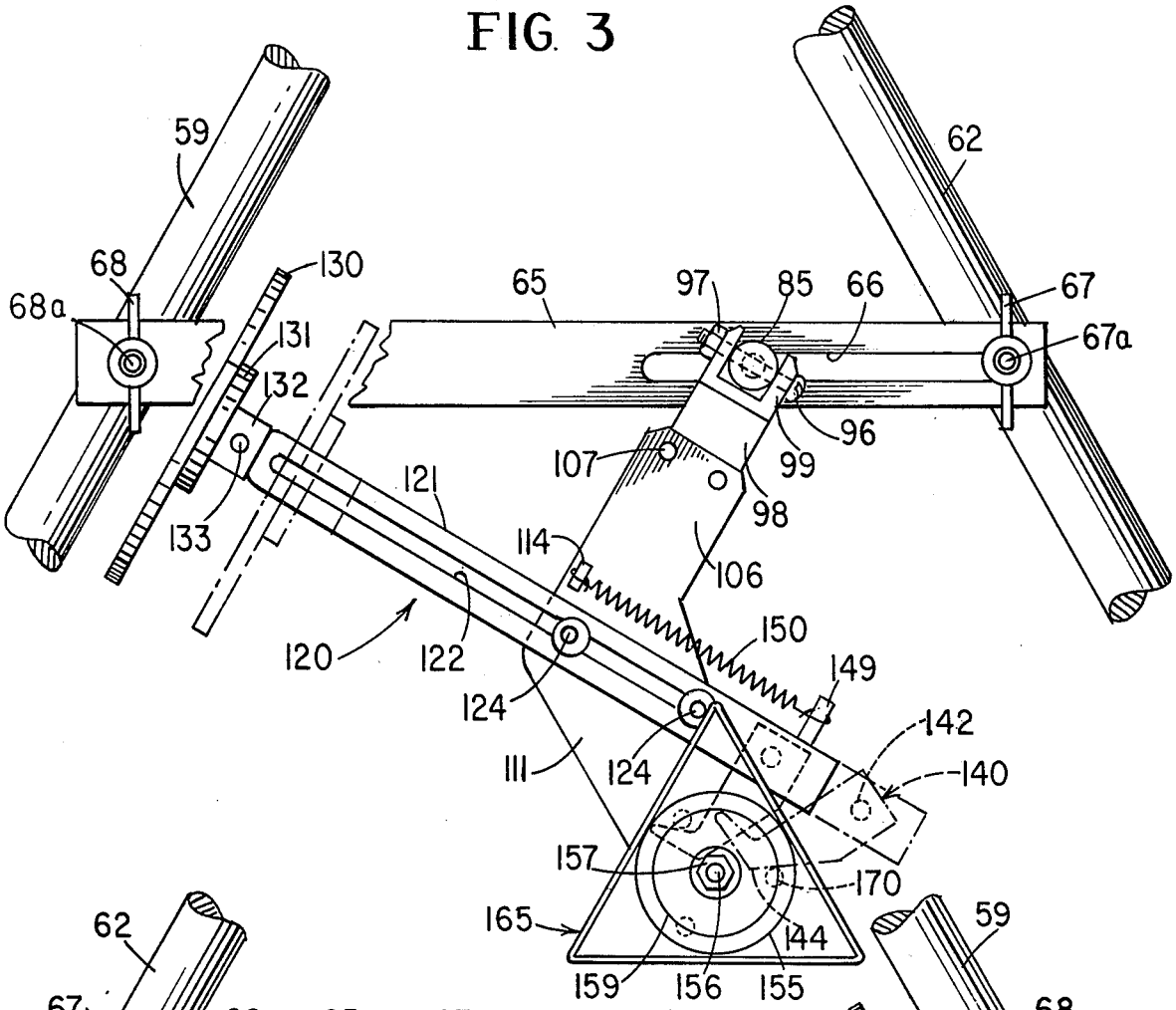
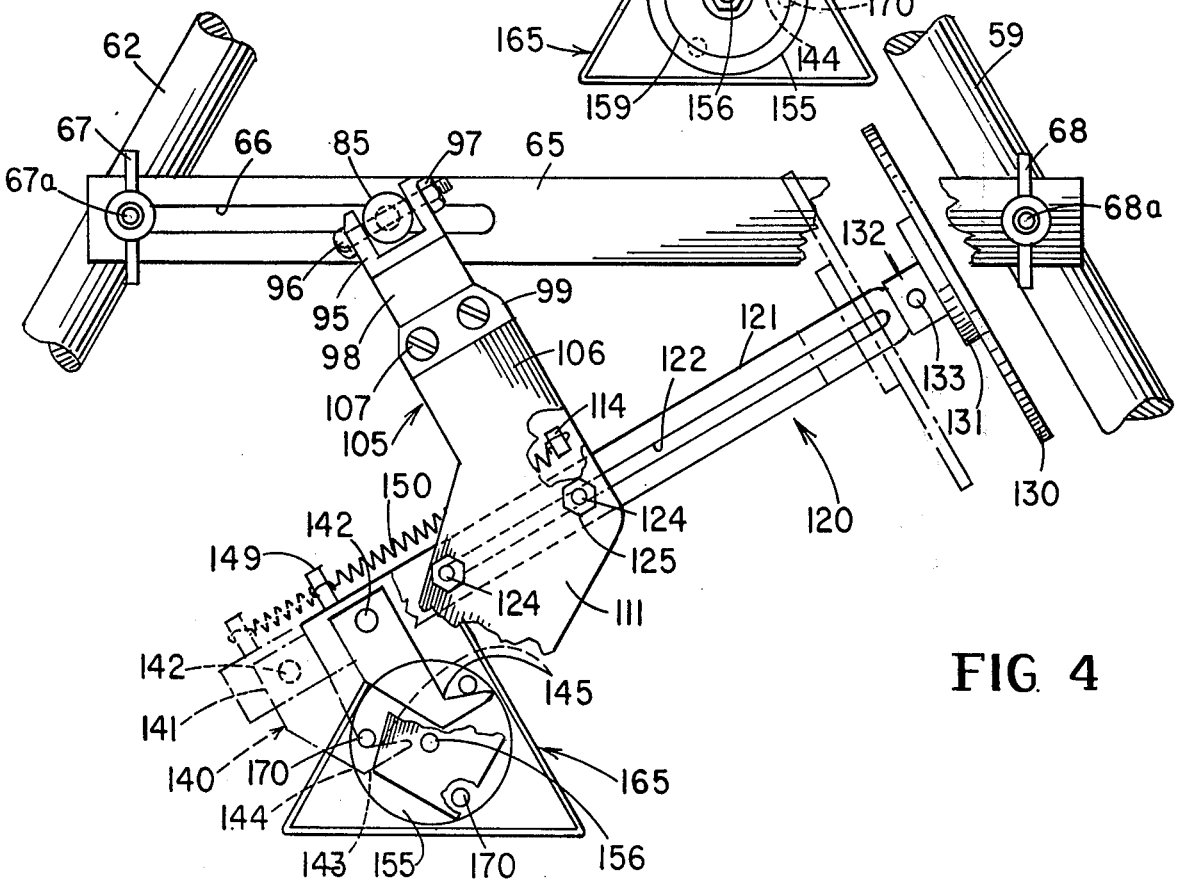
FIG. 4

TARGET WITH SCORE INDICATOR

BACKGROUND OF THE INVENTION

Pitch back games are not new, but generally involve various mechanisms for indicating a score which are either complicated and thereby expensive to produce or awkward in appearance thereby being difficult to read and understand. Additionally, many mechanisms are subject to failure and the like resulting in the game being inoperative.

Representative of the prior art devices in this field, is the device described in U.S. Pat. No. 3,206,196 issued Sept. 14, 1965 to C. E. Jackson. In that device, electronic signals are generated upon the impact of the ball against the net, which electronic signals illuminate a score indicating mechanism at the top of the target area. Since the device depends on a plurality of electrical components with a rather complicated mechanical support system, the device is complicated and can be subject to failure.

U.S. Pat. No. 3,706,451 issued Dec. 19, 1972 to Dickson, discloses a device which depends on tensioned cords forming a harness to operate the device. This design is also subject to problems if the tension varies in the device.

U.S. Pat. No. 3,963,240 issued June 15, 1976 to Tidwell, describes a mechanism which forcefully returns the pitched object to the thrower and combines an audio gong to register the successful score. This device is somewhat complicated and requires substantial skill to operate.

For all the foregoing reasons, the devices available in the field suffer from one of many faults common to most devices, wherein either the device is complicated and subject to breakdown, expensive to manufacture and to produce or difficult for the user to operate successfully. All of these problems have been overcome by the subject invention which provides a mechanically operated device with few moving parts so constructed and arranged to operate in a substantially fail safe manner. Adjustment features are provided to vary the difficulty of actuating the device to register a score.

SUMMARY OF THE INVENTION

This invention relates to a target scoring device in which a trigger is mounted behind a resilient net for reciprocating movement in which the reciprocating movement actuates a scoring indicator, and more particularly, this invention relates to a device wherein a trigger carries a cam follower which actuates a cam carrying the score indicator.

An important object of the present invention is to provide an entirely mechanical device which is easy to construct and operate and which has few moving parts to render the operation substantially fail safe.

Another object of the present invention is to provide a target scoring device which is easily adjustable so that the score indicating mechanism is actuated either very easily or only by a substantially perfect throw.

Another object of the present invention is to provide a target scoring device comprising a target formed of a resilient material, a trigger positioned behind the target and movable toward and away therefrom, score indicating mechanism operatively connected to the trigger and responsive to movement of the trigger toward the target to indicate a score, and spring means continually urging the trigger toward the target, whereby movement of the target against the trigger due to the target being struck by a thrown object results in movement of the trigger away from the target followed by movement of the trigger toward the target due to the spring means thereby operating the score indicating mechanism to show the score.

A further object of the present invention is to provide a target scoring device of the type set forth in which a target formed of a resilient material is mounted on a frame, the trigger is mounted on the frame behind the target for reciprocating movement toward and away from the target, the cam is mounted on the frame having a score indicating indicia connected thereto, the cam follower is connected to the trigger for indexing the cam in response to reciprocating movement of the trigger, and a spring continually urges the trigger toward the target, whereby movement of the target against the trigger due to the target being struck by a thrown object results in reciprocating movement of the trigger away from the target followed by movement of the trigger toward the target causing the cam follower to engage the cam and index same and the score indicating indicia to indicate the score.

A still further object of the present invention is to provide a target scoring device of the type set forth in which a circular cam having three pegs mounted thereon at 120 degree intervals is rotatably mounted on a support forming a portion of the frame, the support having spaced apart mounting lugs thereon receiving a slotted member carrying the trigger.

These and other objects of the present invention will be more readily understood by reference to the following specification taken in conjunction with the accompanying drawings, in which:

BRIEF DESCRIPTION OF THE DRAWINGS

FIG. 3 is an enlarged elevational view of the trigger mechanism and score indicator mechanism as seen in FIG. 1 as viewed from the right-hand side thereof; and FIG. 4 is an enlarged side elevational view of the trigger and score indicating mechanism illustrated in FIG. 1 as viewed from the left-hand side thereof.

DETAILED DESCRIPTION OF THE PREFERRED EMBODIMENT

Figure 1:
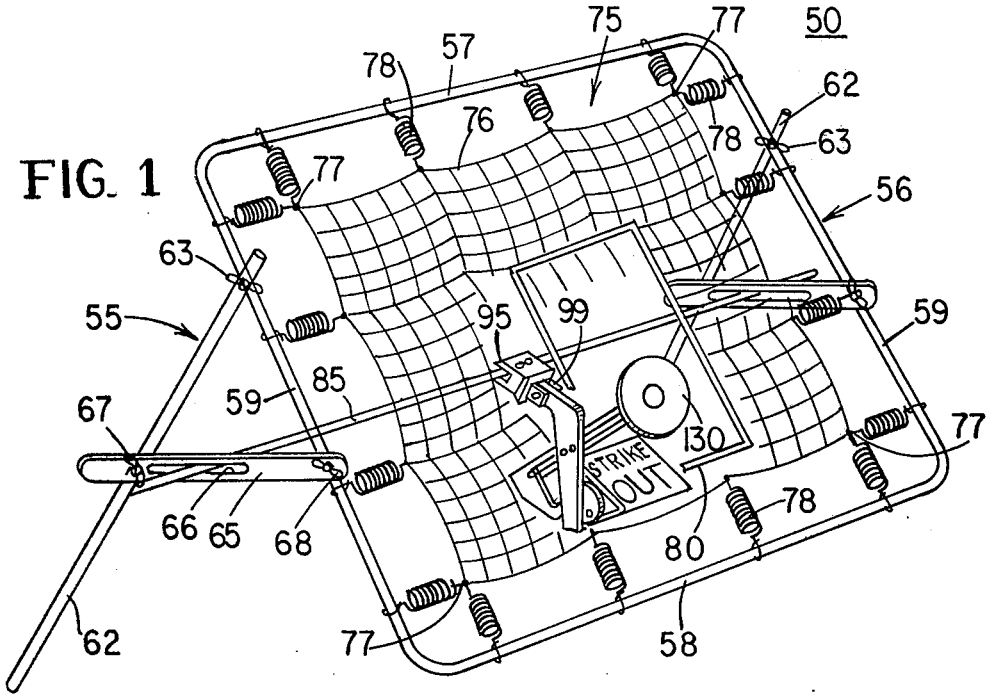
FIG. 1 is a perspective view of the target scoring device of the present invention.

Referring now to the drawings, there is illustrated a target scoring device 50 which includes a frame 55 formed of a square tubular member 56 including a top reach 57, a bottom reach 58 and side reaches 59. A pair of legs 62 in the form of tubular members is provided with each leg 62 being connected by a fastener 63 such as a wing nut and bolt to one of the side reaches 59 of the frame member 55. A horizontally positioned support 65 interconnects each of the legs 62 with the associated side reach 59 from a point approximately in the middle of the leg 62 to a point substantially below the fastener 63, thereby to provide stability to the target scoring device 50. Specifically, each of the horizontal supports 65 is provided with an elongated adjusting slot 66 and is connected to the associated leg 62 by a wing nut 67 threadably fastened to a stud **67*a* extending outwardly from the associated leg and by a wing nut 68 threadably connected to a stud 68*a* extending outwardly from the associated side reach 59**.

A target 75 is comprised of a net 76 having four corners 77 resiliently mounted to the frame 55 by means of springs 78. It should be noted that two springs 78 connect each of the corners 77 of the net 76 to the frame member 55 and intermediate springs 78 interconnect the horizontal and vertical reaches of the net 76 to the frame member 55 and particularly to the square tubular members 56, thereby providing a resilient target 75. Near the center of the target 75, is a defined area 80 illustrated as a rectangle, but it is understood that the defined area 80 may be of any geometric shape and may be positioned with respect to the net 76 as desired.

Figure 2:
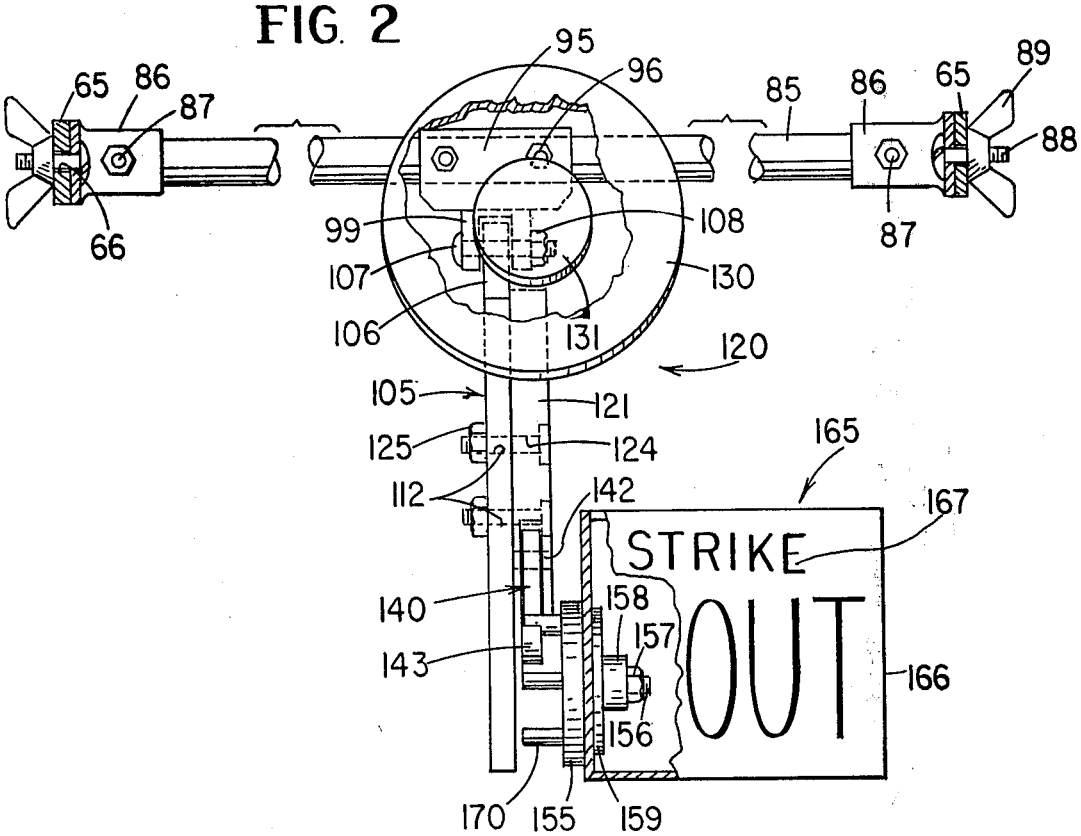
FIG. 2 is a front plan view of the trigger device situated behind the resilient material forming the target.

The frame 55 further includes a cross bar 85 having end mounting brackets 86 connected at the distal ends of the bar 85 by set screws 87. Each of the mounting brackets 86 is connected to or mounted on the associated horizontal support 65 by means of a screw 88 and wing nut 89, as best seen in FIG. 2. A central bracket 95 is fixedly mounted to the cross bar 85 by means of spaced apart screws 96 and nuts 97 therefor, see FIG. 4, the screws 96 extending through the hollow cross bar 85. The central bracket 95 has a base 98 depending therefrom which terminates in a clevis 99. A support arm 105 having an upper leg 106 is fixedly mounted in the clevis 99 by spaced apart screws 107 and nuts 108 therefor. The support arm 105 has a lower leg 111 angularly disposed to the upper leg 106, but contiguous therewith, which lower leg 111 is provided with spaced apart apertures 112 therein (see FIG. 2). A mounting stub shaft 114 is fixedly connected to the support arm 105 on the lower leg 111 thereof adjacent the juncture of the lower leg and the upper leg 106.

A trigger 120 is reciprocally mounted on the support arm 105 and positioned behind the target 75. The trigger 120 includes an elongated shaft 121 having a slot 122 extending substantially the entire longitudinal length of the shank 121. Spaced apart studs 124 slidably mount the trigger 120 to the support arm 105, the studs 124 being provided with fasteners 125.

A circular plate 130 is mounted at one distal end of the shank 121 by means of a mounting plate 131 having a collar 132 connected to the associated end of the elongated shank 121 by a set screw 133. At the other end of the elongated shank 121 is a cam follower 140 which has a shank 141 pivotally mounted to the associated end of the shank 121 by a pivot pin 142. A leg 143 extends from the shank 141 at an angle with respect thereto and is provided with a rear contact surface 144 and a front contact surface 145. Finally, a dowel or stub shaft 149 extends upwardly from the end of the elongated shank 121 adjacent the cam follower 140 and serves as a connection point for a spring 150 which interconnects the trigger 120 and the support arm 105 by being connected to both the stub shaft 149 and the stub shaft 114. The spring 150 continually urges the trigger 120 with the circular plate 130 thereon toward the resilient net 76, the slot 122 defining the travel path of the trigger 120.

A circular cam 155 is rotatably mounted to the support arm 105 at the bottom of the bottom leg 111 thereof by means of a pivot pin 156, see FIG. 3, and a nut 157. A collar 158, see FIG. 2, serves to trap a mounting plate 159 against the cam 155 such that rotation of the cam results in rotation of the mounting plate 159. A score indicator 165 is fixedly mounted between the mounting plate 159 and the cam 155 so as to rotate with both the cam 155 and the mounting plate 159. Specifically, the score indicator 165 is comprised of three sides 166, each having indicia 167 thereon, such as strike one on one side, strike two on the second side, and strike out on the third side. Finally, three pins 170 extend outwardly from the cam 155 opposite to the score indicator 165, the pins 170 being spaced apart 120° along a circle constructed and arranged to be engaged by the cam follower 140 in a manner hereinafter set forth.

Operation of the target scoring device 50 is as follows. The tension in the target 75 is principally determined by the springs 78 as well as the fabric making up the net 76. While it is possible to vary the tension in the target 75 by substituting heavier or lighter springs 78, it is not contemplated to make an adjustment in the tension of the target 75 in this fashion. Accordingly, in general the tension of the target 75 will be set and remain constant. The defined area 80 is also not planned or contemplated to be changed; however, it is clear that alternate defined areas 80 may be included with the target game 50 as sold.

The legs 62 provide the first basic adjustment to the angle at which the target 75 is presented to the thrower. By adjusting the legs 62 closer to the target 75, the target will be more toward the vertical and presents a more difficult target area to be pitched at. Moving the leg 62 away from the target, inclines the target 75 and presents a greater area for the user to hit. After the leg 62 has been set at the desired position, they are locked in place by tightening the wing nuts 67 and 68. Thereafter, the cross bar 85 is adjusted by means of the wing nuts 89 to position the trigger 120 at the desired location. Moving the trigger 120 toward the resilient target 75 enables the trigger to be actuated by a less direct hit, that is, one in an area wider than the defined area 80 or alternately by a thrown object which has a lower velocity. Moving the cross bar 85 away from the resilient target 75 decreases the defined area which will actuate the trigger and also requires a higher velocity hit.

After the desired distance for the trigger 120 with respect to the target 75 has been chosen, the wing nuts 89 are tightened thereby fixing the distance between the trigger 120 and particularly the circular plate 130 and the target 75. The trigger 120 is in a fixed angular relation with respect to the net 76, since both the central bracket 95 and the support arm 105 are fixed with respect to the central bar 85. The central bracket 95 is fixed due to the spaced apart screws and fasteners 96 and 97 and the support arm 105 is fixed due to the spaced apart screws and nuts 107 and 108. The spring 150 which interconnects the trigger 120 and the support arm 105 continually urges the trigger toward the resilient net 76, the path of the trigger being defined at least in part by the slot 122 in the elongated shank 121. The trigger 120 in its normal position is shown in full line in both FIGS. 3 and 4. The cam follower 140, in the normal position thereof, is in the full line position of FIG. 4 in which the front contact surface 145 is in abutment with one of the pins 170.

When a projectile hits the resilient target 75 and thus the circular plate 130 of the trigger 120, rearward movement of the trigger 120 results so that the spring 150 is put into tension and the trigger moves to the dotted line position of FIGS. 3 and 4. As seen in FIGS. 3 and 4, the cam follower 140 is moved rearwardly away from the target 75 and the rear contact side 144 engages the rearward pin 170 and because the cam follower is pivotally mounted to the trigger 120 as at 142, the cam follower is free to pivot until the front contact surface 145 is in contact with the pin 170 as illustrated in the dotted line position of FIG. 4. Thereafter, the spring 150 causes the trigger 120 to move forward toward the target 75 to the full line position of FIGS. 3 and 4, thereby causing the indicator 165 to rotate through an angle of 120°. A stop (not shown) prevents the cam follower 140 from pivoting during movement thereof from the dotted line to the full line positions, but allows pivoting during movement from the full line to the dotted line positions. During the rotation of the score indicator 165 through an angle of 120°, the next side of the three sided indicator is presented for view. Successive actuations of the trigger 120 result in successive sides of the indicator 165 being brought into view, since the indicator as illustrated, is positioned to the side of the trigger 120 and is clearly visible to the user of the target game 50 through the net 76.

As may be seen, the entire mechanism of the target device or game 50, is mechanical in nature and constructed of relatively reliable mechanical parts, whereby the chance of mechanical failure due to continued and hard use is reduced. Further, the device 50 is easily adjustable to accommodate different age groups, since positioning of the target 75 toward or away from the vertical reduces or increases the area which will cause the trigger 120 to be actuated. Similarly, movement or adjustment of the cross bar 85 toward or away from the target 75 makes actuation of the trigger easier or more difficult. The combination of these two adjustment features with the particular reciprocating nature of the trigger, wherein the score indicating device 165 is readily visible to the user provides a unique and highly desirable game. Additionally, the resiliency of the target 75 can be such that the thrown object is returned approximately to the area of the user.

While there has been disclosed what at present is considered to be the preferred embodiment of the present invention, it will be understood that various modifications and alterations may be made therein without departing from the true spirit and scope of the present invention and it is intended to cover in the appended claims all such modifications and alterations.

What is claimed is:

1. A target scoring device comprising a target formed of resilient material, a trigger having an elongated arm positioned behind said target and linearly moveable in reciprocating motion toward and away therefrom, score indicating mechanism operatively connected to said trigger and responsive to movement of said trigger toward said target to indicate a score, and spring means continually urging said trigger toward said target, whereby movement of said target against trigger due to said target being struck by a thrown object results in movement of said trigger away from said target followed by movement of said trigger toward said target due to said spring means thereby operating said score indicating mechanism to show the score.

2. The target scoring device set forth in claim 1, wherein said target has a scoring area defined thereon.

3. The target scoring device set forth in claim 1, wherein said trigger has a plate mounted on said elongated arm.

4. The target scoring device set forth in claim 1, wherein said score indicating mechanism includes a disc having three substantially discrete positions to indicate three successive scores.

5. A target scoring device comprising a target formed of resilient material mounted on a frame, a trigger having an elongated slotted member mounted on said frame behind said target for reciprocating movement toward and away from said target, a cam mounted on said frame having score indicating indicia connected thereto, a cam follower pivotally mounted on said elongated member of said trigger for indexing said cam in response to reciprocating movement of said trigger, and a spring continually urging said trigger toward said target, whereby movement of said target against said trigger due to said target being struck by a thrown object results in reciprocating movement of said trigger away from said target followed by movement of said trigger toward said target followed by movement of said trigger toward said target causing said cam follower to engage said cam and index same and the score indicating indicia to indicate the score.

6. The target scoring device set forth in claim 5, wherein said frame includes spaced apart legs adjustable toward and away from said target and a cross beam carrying said trigger and said cam, said cross beam being movable toward and away from said target independently of the position of said legs.

7. The target scoring device set forth in claim 5, wherein said cam is circular with three pegs extending outwardly therefrom normal to the plane thereof spaced at 60 degree intervals, said pivoted cam follower successively engaging said pegs in response to reciprocating movement of said trigger.

8. The target scoring device set forth in claim 7, wherein said score indicating indicia is a three sided triangular member mounted to said circular cam.

9. The target scoring device set forth in claim 7, wherein said cam is rotatably mounted on a support forming a portion of said frame, said support having two spaced apart mounting lugs thereon receiving said slotted member thereon for reciprocating movement of said trigger toward and away from said target.

* * * * *